US011874039B2

(12) United States Patent
Ochiai et al.

(10) Patent No.: US 11,874,039 B2
(45) Date of Patent: Jan. 16, 2024

(54) REFRIGERATION CYCLE APPARATUS

(71) Applicant: Mitsubishi Electric Corporation, Tokyo (JP)

(72) Inventors: Yasutaka Ochiai, Tokyo (JP); Kazuhiro Komatsu, Tokyo (JP); Nobuaki Tasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 413 days.

(21) Appl. No.: 17/418,312

(22) PCT Filed: Aug. 1, 2019

(86) PCT No.: PCT/JP2019/030222
§ 371 (c)(1),
(2) Date: Jun. 25, 2021

(87) PCT Pub. No.: WO2020/170470
PCT Pub. Date: Aug. 27, 2020

(65) Prior Publication Data

US 2022/0065511 A1 Mar. 3, 2022

(30) Foreign Application Priority Data

Feb. 21, 2019 (JP) ..... 2019-029575

(51) Int. Cl.
*G01K 13/00* (2021.01)
*F25B 49/02* (2006.01)
(Continued)

(52) U.S. Cl.
CPC ..... *F25B 49/02* (2013.01); *F25B 13/00* (2013.01); *F25B 41/20* (2021.01);
(Continued)

(58) Field of Classification Search
CPC ..... F25B 49/02; F25B 41/20; F25B 13/00; F25B 2313/0231; F25B 13/0233; F25B 2700/2103; F25B 2700/21174
(Continued)

(56) References Cited

U.S. PATENT DOCUMENTS

2014/0238060 A1 8/2014 Tamaki et al.

FOREIGN PATENT DOCUMENTS

JP 2000-274896 A 10/2000
JP 2007-333219 A 12/2007
(Continued)

OTHER PUBLICATIONS

Extended European Search Report dated Feb. 25, 2022 issued in corresponding European patent application No. 19916268.6.
(Continued)

*Primary Examiner* — Davis D Hwu
(74) *Attorney, Agent, or Firm* — POSZ LAW GROUP, PLC

(57) ABSTRACT

A refrigeration cycle apparatus includes a refrigeration cycle circuit, a bypass flow path, a first valve provided in the refrigeration cycle circuit, a second valve provided at the bypass flow path, a first temperature sensor configured to detect a temperature of an indoor space, a second temperature sensor configured to detect a temperature of refrigerant on a liquid side of an indoor heat exchanger, and a notification part. The refrigeration cycle apparatus is able to operate in an operation state where the compressor operates, the indoor heat exchanger functions as an evaporator, and the first valve is open while the second valve is closed. In the operation state, the notification part issues notification of an abnormality of an electronic expansion valve or the first valve when a temperature detected by the second tempera-
(Continued)

ture sensor is higher than an evaporation temperature of refrigerant in the refrigeration cycle circuit.

6 Claims, 7 Drawing Sheets

(51) Int. Cl.
*F25B 41/20* (2021.01)
*F25B 13/00* (2006.01)

(52) U.S. Cl.
CPC ..... *F25B 2313/0232* (2013.01); *F25B 2313/0233* (2013.01); *F25B 2700/2103* (2013.01); *F25B 2700/21174* (2013.01)

(58) Field of Classification Search
USPC ..... 62/129
See application file for complete search history.

(56) References Cited

FOREIGN PATENT DOCUMENTS

| | | | | |
|---|---|---|---|---|
| JP | 2016-508590 | A | | 3/2016 |
| JP | 108698475 | A | * | 10/2018 |

OTHER PUBLICATIONS

International Search Report dated Sep. 10, 2019, issued in corresponding International Application No. PCT/JP2019/030222.

* cited by examiner

FIG. 2

| | STATE PATTERN 1 | STATE PATTERN 2 | STATE PATTERN 3 | STATE PATTERN 4 |
|---|---|---|---|---|
| | NORMAL | ELECTRONIC EXPANSION VALVE IS LOCKED CLOSED | LOW PRESSURE VALVE IS LOCKED CLOSED | HIGH PRESSURE VALVE IS LOCKED CLOSED |
| STATE OF ELECTRONIC EXPANSION VALVE | SH CONTROL | CLOSED | SH CONTROL | SH CONTROL |
| STATE OF LOW PRESSURE VALVE | OPEN | OPEN | CLOSED | OPEN |
| STATE OF HIGH PRESSURE VALVE | CLOSED | CLOSED | CLOSED | OPEN |

FIG. 3

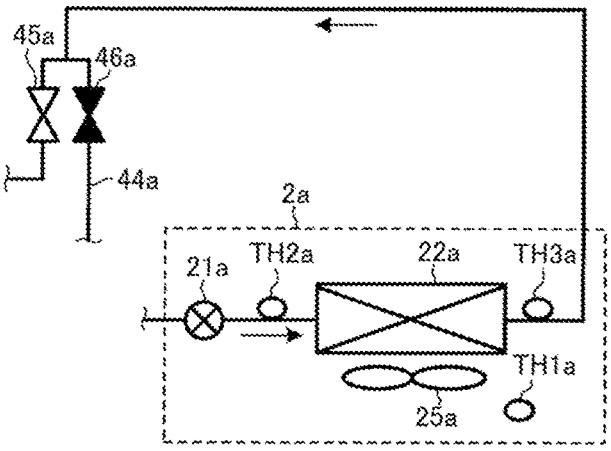

FIG. 4

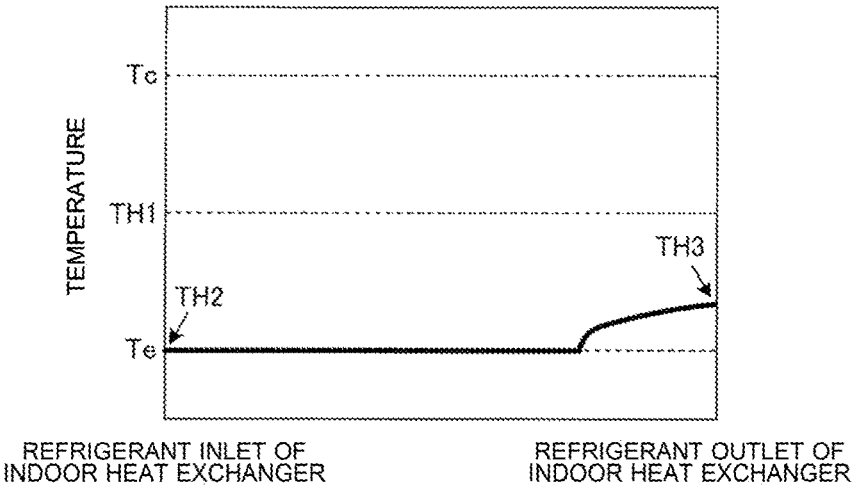

REFRIGERATION CYCLE APPARATUS

CROSS REFERENCE TO RELATED APPLICATION

This application is a U.S. National Stage Application of International Application No. PCT/JP2019/030222, filed on Aug. 1, 2019, that claims priority from Japanese Patent Application number 2019-029575 filed on Feb. 21, 2019, the contents of which are incorporated herein by reference.

TECHNICAL FIELD

The present disclosure relates to a refrigeration cycle apparatus including a refrigeration cycle circuit.

BACKGROUND ART

Patent Literature 1 describes an air conditioning apparatus capable of detecting an abnormality of an expansion valve by itself. This air conditioning apparatus includes a compressor, a condenser, an electronic expansion valve, and an evaporator. A temperature sensor configured to detect the temperature of the evaporator is provided between the electronic expansion valve and the evaporator. A temperature sensor configured to detect the temperature of air taken through an air inlet of the evaporator is provided at the air inlet of the evaporator. In an abnormality detection device, an operation for detecting an abnormality of the electronic expansion valve is performed on the basis of the temperatures detected by the individual temperature sensors.

CITATION LIST

Patent Literature

Patent Literature 1: Japanese Unexamined Patent Application Publication No. 2000-274896

SUMMARY OF INVENTION

Technical Problem

For example, in a multi-type refrigeration cycle apparatus capable of performing a simultaneous cooling-heating operation, a plurality of indoor heat exchangers are each provided with two solenoid valves for switching the direction of flow of refrigerant at the indoor heat exchanger. In this manner, for a refrigeration cycle apparatus in which one indoor heat exchanger is provided with an electronic expansion valve and two solenoid valves, there is a problem in that there may be a case where it is difficult to accurately detect which one of the electronic expansion valve and the two solenoid valves has an abnormality.

The present disclosure has been made to solve the above-described problem, and an object thereof is to provide a refrigeration cycle apparatus capable of detecting an abnormality of a valve more accurately.

Solution to Problem

A refrigeration cycle apparatus according to an embodiment of the present disclosure includes a refrigeration cycle circuit including a compressor, a refrigerant flow switching device, an outdoor heat exchanger, an expansion device, and an indoor heat exchanger, a bypass flow path connecting a first branch part provided between the outdoor heat exchanger and the expansion device in the refrigeration cycle circuit to a second branch part provided between the indoor heat exchanger and the refrigerant flow switching device in the refrigeration cycle circuit, a first valve provided between the second branch part and the refrigerant flow switching device in the refrigeration cycle circuit, a second valve provided at the bypass flow path, a first temperature sensor configured to detect a temperature of an indoor space to which air passing through the indoor heat exchanger is supplied, a second temperature sensor configured to detect a temperature of refrigerant on a liquid side of the indoor heat exchanger, and a notification part configured to perform abnormality notification. The expansion device is an electronic expansion valve, the refrigeration cycle apparatus is able to operate in an operation state where the compressor operates, the indoor heat exchanger functions as an evaporator, and the first valve is open while the second valve is closed, and in the operation state, the notification part issues notification of an abnormality of the electronic expansion valve or the first valve when a temperature detected by the second temperature sensor is higher than an evaporation temperature of the refrigerant in the refrigeration cycle circuit.

Advantageous Effects of Invention

In the operation state where the compressor operates, the indoor heat exchanger functions as an evaporator, and the first valve is open while the second valve is closed, when an abnormality occurs in the electronic expansion valve or the first valve, a temperature detected by the second temperature sensor becomes higher than the evaporation temperature of the refrigerant in the refrigeration cycle circuit. Thus, according to an embodiment of the present disclosure, an abnormality of a valve can be detected more accurately.

BRIEF DESCRIPTION OF DRAWINGS

FIG. 2 is a diagram illustrating an example of combination patterns of states that an electronic expansion valve 21*a*, a low pressure valve 45*a*, and a high pressure valve 46*a* may enter in the refrigeration cycle apparatus according to Embodiment 1 of the present disclosure.

FIG. 3 is a diagram illustrating operation of the electronic expansion valve 21*a*, the low pressure valve 45*a*, and the high pressure valve 46*a* in a state pattern 1 in the refrigeration cycle apparatus according to Embodiment 1 of the present disclosure.

FIG. 4 is a graph illustrating a temperature distribution of refrigerant in an indoor heat exchanger 22*a* in the state pattern 1 in the refrigeration cycle apparatus according to Embodiment 1 of the present disclosure.

DESCRIPTION OF EMBODIMENTS

Embodiment 1

Figure 1:
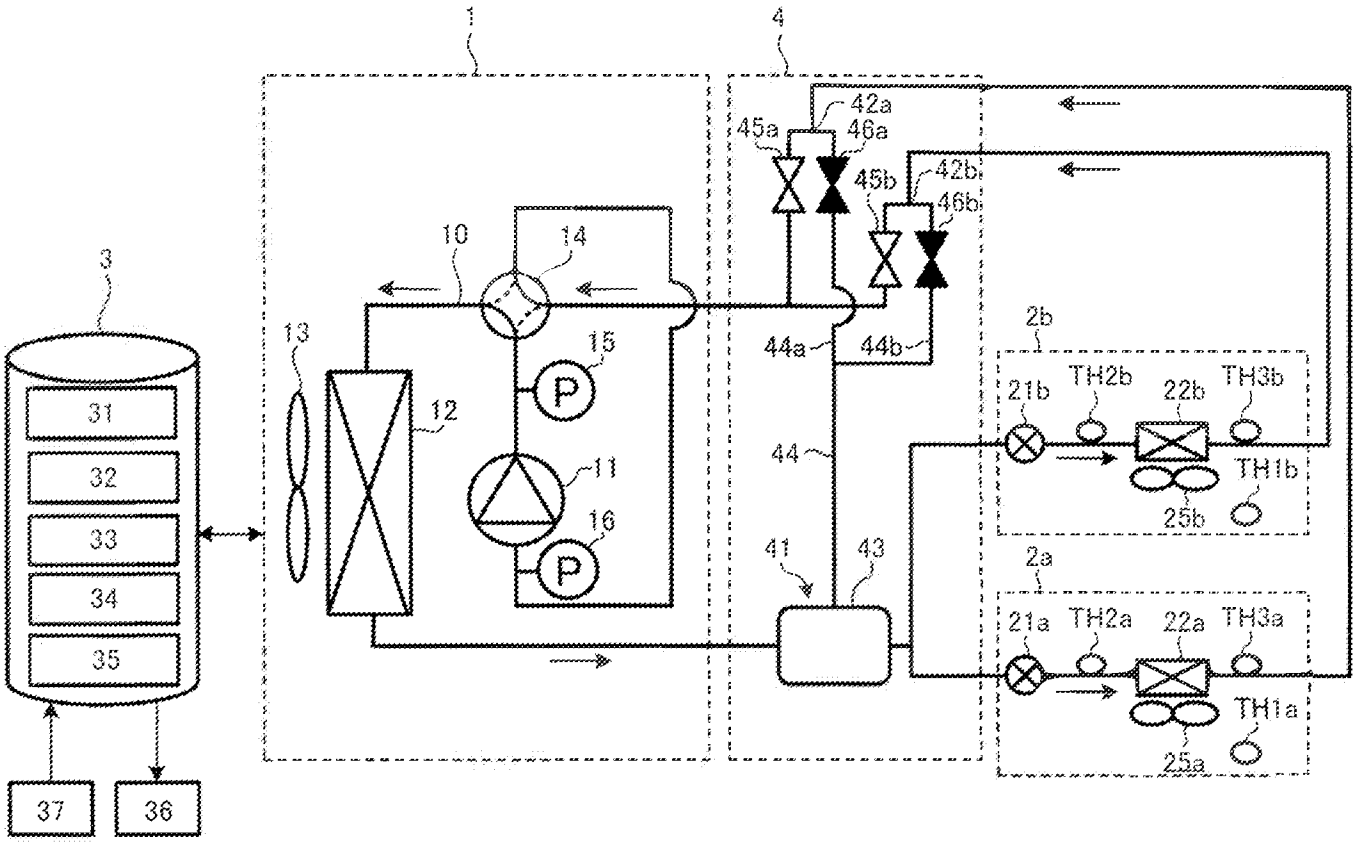
FIG. 1 is a diagram illustrating the configuration of a refrigeration cycle apparatus according to Embodiment 1 of the present disclosure.

A refrigeration cycle apparatus according to Embodiment 1 of the present disclosure will be described. FIG. 1 is a diagram illustrating the configuration of the refrigeration cycle apparatus according to Embodiment 1. In Embodiment 1, a multi-type air-conditioning apparatus capable of performing a simultaneous cooling-heating operation is described as an example of the refrigeration cycle apparatus. As illustrated in FIG. 1, the refrigeration cycle apparatus has a refrigeration cycle circuit 10 configured to circulate refrigerant and a controller 3 configured to control the entire refrigeration cycle apparatus including the refrigeration cycle circuit 10.

The refrigeration cycle circuit 10 has a configuration in which a compressor 11, a refrigerant flow switching device 14, an outdoor heat exchanger 12, electronic expansion valves 21*a* and 21*b*, and indoor heat exchangers 22*a* and 22*b* are connected in an annular shape via refrigerant pipes. In the refrigeration cycle circuit 10, a pair of the electronic expansion valve 21*a* and the indoor heat exchanger 22*a* and a pair of the electronic expansion valve 21*b* and the indoor heat exchanger 22*b* are connected in parallel to each other. In Embodiment 1, there are two pairs of an electronic expansion valve and an indoor heat exchanger; however, the number of pairs of an electronic expansion valve and an indoor heat exchanger may be one or three or more.

A bypass flow path 44, which bypasses the electronic expansion valves 21*a* and 21*b* and the indoor heat exchangers 22*a* and 22*b*, is connected to the refrigeration cycle circuit 10. One end portion of the bypass flow path 44 is connected to a first branch part 41 provided between the outdoor heat exchanger 12 and the electronic expansion valve 21*a* and between the outdoor heat exchanger 12 and the electronic expansion valve 21*b* in the refrigeration cycle circuit 10. The first branch part 41 is provided with a gas-liquid separator 43.

The other end portion of the bypass flow path 44 is split into a plurality of branch flow paths 44*a* and 44*b*. The branch flow paths 44*a* and 44*b* are respectively provided to correspond to indoor units 2*a* and 2*b*, which will be described later. There are as many branch flow paths 44*a* and 44*b* as there are indoor units 2*a* and 2*b*, that is, indoor heat exchangers 22*a* and 22*b*. The branch flow path 44*a* is connected to a second branch part 42*a* provided between the indoor heat exchanger 22*a* and the refrigerant flow switching device 14 in the refrigeration cycle circuit 10. The branch flow path 44*b* is connected to a second branch part 42*b* provided between the indoor heat exchanger 22*b* and the refrigerant flow switching device 14 in the refrigeration cycle circuit 10. The second branch parts 42*a* and 42*b* are respectively provided to correspond to the indoor units 2*a* and 2*b*. There are as many second branch parts 42*a* and 42*b* as there are indoor units 2*a* and 2*b*, that is, indoor heat exchangers 22*a* and 22*b*.

A low pressure valve 45*a* is provided between the second branch part 42*a* and the refrigerant flow switching device 14 in the refrigeration cycle circuit 10. A low pressure valve 45*b* is provided between the second branch part 42*b* and the refrigerant flow switching device 14 in the refrigeration cycle circuit 10. Each of the low pressure valves 45*a* and 45*b* is an example of a first valve. The low pressure valves 45*a* and 45*b* are respectively provided to correspond to the indoor units 2*a* and 2*b*. There are as many low pressure valves 45*a* and 45*b* as there are indoor units 2*a* and 2*b*, that is, indoor heat exchangers 22*a* and 22*b*.

The branch flow path 44*a* of the bypass flow path 44 is provided with a high pressure valve 46*a*. The branch flow path 44*b* of the bypass flow path 44 is provided with a high pressure valve 46*b*. Each of the high pressure valves 46*a* and 46*b* is an example of a second valve. The high pressure valves 46*a* and 46*b* are respectively provided to correspond to the indoor units 2*a* and 2*b*. There are as many high pressure valves 46*a* and 46*b* as there are indoor units 2*a* and 2*b*, that is, indoor heat exchangers 22*a* and 22*b*.

Moreover, the refrigeration cycle apparatus has an outdoor unit 1, a branch controller 4, and the two indoor units 2*a* and 2*b*. The outdoor unit 1 is connected to the branch controller 4 with two refrigerant pipes interposed therebetween. The branch controller 4 is connected to each of the two indoor units 2*a* and 2*b* with two refrigerant pipes interposed therebetween. One outdoor unit, which is the one outdoor unit 1, is described as an example in Embodiment 1; however, there may be two or more outdoor units. Moreover, one branch controller, which is the branch controller 4, is described as an example in Embodiment 1; however, there may be two or more branch controllers. Furthermore, two indoor units, which are the indoor units 2*a* and 2*b*, are described as an example in Embodiment 1; however, there may be one indoor unit or three or more indoor units. The outdoor unit 1 may be connected to the branch controller 4 with three refrigerant pipes interposed therebetween.

The outdoor unit 1 is installed, for example, outdoors. The outdoor unit 1 houses the compressor 11, the refrigerant flow switching device 14, and the outdoor heat exchanger 12 described above and an outdoor fan 13, a high-pressure sensor 15, and a low-pressure sensor 16.

The compressor 11 is a fluid machine that sucks and compresses low-pressure low-temperature gas refrigerant to discharge high-pressure high-temperature gas refrigerant.

When the compressor 11 operates, refrigerant circulates through the refrigeration cycle circuit 10. An inverter-driven compressor capable of adjusting the operating frequency is used as the compressor 11. Operation of the compressor 11 is controlled by the controller 3.

The refrigerant flow switching device 14 is a valve that switches the direction in which refrigerant flows between when a cooling main operation is performed and when a heating main operation is performed. The refrigerant flow switching device 14 is controlled by the controller 3 such that a flow path indicated by a solid line in FIG. 1 is set at the time of the cooling main operation, and a flow path indicated by broken lines in FIG. 1 is set at the time of the heating main operation. The cooling main operation is an operation mode executed when the cooling load is greater than the heating load at the indoor units 2*a* and 2*b*. The cooling main operation includes a cooling only operation, in which both the indoor units 2*a* and 2*b* perform a cooling operation. The heating main operation is an operation mode executed when the heating load is greater than the cooling load at the indoor units 2*a* and 2*b*. The heating main operation includes a heating only operation, in which both the indoor units 2*a* and 2*b* perform a heating operation. For example, a four-way valve is used as the refrigerant flow switching device 14.

The outdoor heat exchanger 12 is a heat exchanger functioning as a condenser at the time of the cooling main operation and as an evaporator at the time of the heating main operation. The outdoor heat exchanger 12 exchanges heat between refrigerant and outdoor air.

The outdoor fan 13 is configured to supply outdoor air to the outdoor heat exchanger 12. A motor-driven propeller fan is used as the outdoor fan 13. When the outdoor fan 13 operates, outdoor air is sucked into the inside of the outdoor unit 1, passes through the outdoor heat exchanger 12, and is then ejected to outside the outdoor unit 1. Operation of the outdoor fan 13 is controlled by the controller 3.

The high-pressure sensor 15 is provided at a discharge pipe between the compressor 11 and the refrigerant flow switching device 14 in the refrigeration cycle circuit 10, that is, on the discharge side of the compressor 11. The high-pressure sensor 15 is configured to detect high pressure in the refrigeration cycle circuit 10 and outputs a detection signal to the controller 3. In the controller 3, a condensing temperature Tc of the refrigerant in the refrigeration cycle circuit 10 is calculated on the basis of the high pressure in the refrigeration cycle circuit 10.

The low-pressure sensor 16 is provided at a suction pipe between the refrigerant flow switching device 14 and the compressor 11 in the refrigeration cycle circuit 10, that is, on the suction side of the compressor 11. The low-pressure sensor 16 is configured to detect low pressure in the refrigeration cycle circuit 10 and outputs a detection signal to the controller 3. In the controller 3, an evaporation temperature Te of the refrigerant in the refrigeration cycle circuit 10 is calculated on the basis of the low pressure in the refrigeration cycle circuit 10.

The indoor unit 2*a* is installed, for example, indoors. The indoor unit 2*a* houses the electronic expansion valve 21*a* and the indoor heat exchanger 22*a* described above and an indoor fan 25*a*, a first temperature sensor TH1*a*, a second temperature sensor TH2*a*, and a third temperature sensor TH3*a*.

The electronic expansion valve 21*a* is a valve that insulates and expands refrigerant. The opening degree of the electronic expansion valve 21*a* is controlled by the controller 3 such that the degree of superheat or subcooling of the refrigerant in the refrigeration cycle circuit 10 approaches a target value. The electronic expansion valve 21*a* is an example of an expansion device. As the expansion device, instead of the electronic expansion valve 21*a*, a fixed expansion valve such as a capillary tube or a thermal expansion valve can be used.

The indoor heat exchanger 22*a* is a heat exchanger functioning as an evaporator in a case where the indoor unit 2*a* performs the cooling operation and as a condenser in a case where the indoor unit 2*a* performs the heating operation. The indoor heat exchanger 22*a* exchanges heat between refrigerant and indoor air.

The indoor fan 25*a* is configured to supply indoor air to the indoor heat exchanger 22*a*. A motor-driven centrifugal fan or cross flow fan is used as the indoor fan 25*a*. When the indoor fan 25*a* operates, indoor air is taken into the inside of the indoor unit 2*a* and passes through the indoor heat exchanger 22*a*, and then the conditioned air is supplied into an indoor space. Operation of the indoor fan 25*a* is controlled by the controller 3.

The first temperature sensor TH1*a* is configured to detect an indoor temperature TH1 of the indoor space, to which conditioned air is supplied from the indoor unit 2*a*, and outputs a detection signal to the controller 3. The first temperature sensor TH1*a* is provided at, for example, an air inlet of the indoor unit 2*a*, which is positioned upstream the indoor heat exchanger 22*a* in the flow of indoor air.

The second temperature sensor TH2*a* is provided between the electronic expansion valve 21*a* and the indoor heat exchanger 22*a* in the refrigeration cycle circuit 10. The second temperature sensor TH2*a* is configured to detect a temperature TH2 of refrigerant on a liquid side of the indoor heat exchanger 22*a*, that is, the temperature of two-phase refrigerant on the input side of the indoor heat exchanger 22*a* when the indoor unit 2*a* performs the cooling operation, and outputs a detection signal to the controller 3. In the following, the temperature of refrigerant on the liquid side may also be referred to as "liquid-side temperature".

The third temperature sensor TH3*a* is provided between the indoor heat exchanger 22*a* and the low pressure valve 45*a* and between the indoor heat exchanger 22*a* and the high pressure valve 46*a* in the refrigeration cycle circuit 10. The third temperature sensor TH3*a* is configured to detect a temperature TH3 of refrigerant on a gas side of the indoor heat exchanger 22*a*, that is, the temperature of superheated gas refrigerant on the output side of the indoor heat exchanger 22*a* when the indoor unit 2*a* performs the cooling operation, and outputs a detection signal to the controller 3. In the following, the temperature of refrigerant on the gas side may also be referred to as "gas-side temperature".

The indoor unit 2*b* is configured substantially the same as the indoor unit 2*a*. The indoor unit 2*b* houses the electronic expansion valve 21*b*, the indoor heat exchanger 22*b*, an indoor fan 25*b*, a first temperature sensor TH1*b*, a second temperature sensor TH2*b*, and a third temperature sensor TH3*b*.

The branch controller 4 is installed, for example, indoors. The branch controller 4 is a relay provided between the outdoor unit 1 and each of the indoor units 2*a* and 2*b* in the flow of refrigerant. The branch controller 4 houses the first branch part 41, the second branch parts 42*a* and 42*b*, the gas-liquid separator 43, the bypass flow path 44, the branch flow paths 44*a* and 44*b*, the low pressure valves 45*a* and 45*b*, and the high pressure valves 46*a* and 46*b* described above.

The gas-liquid separator 43 is configured to separate incoming refrigerant into gas refrigerant and liquid refrigerant. The liquid refrigerant separated at the gas-liquid separator 43 is supplied to an indoor unit performing the cooling operation among the indoor units 2*a* and 2*b*. The gas refrigerant separated at the gas-liquid separator 43 is supplied via the bypass flow path 44 to an indoor unit performing the heating operation among the indoor units 2*a* and 2*b*.

Each of the low pressure valves 45*a* and 45*b* and the high pressure valves 46*a* and 46*b* is an on-off valve capable of opening and closing a flow path. As the low pressure valves 45*a* and 45*b* and the high pressure valves 46*a* and 46*b*, for example, a solenoid valve or a motor operated valve is used. Operation of each of the low pressure valves 45*a* and 45*b* and the high pressure valves 46*a* and 46*b* is controlled by the controller 3. In a case where the indoor unit 2*a* performs the cooling operation, the low pressure valve 45*a* is open, and the high pressure valve 46*a* is closed. In a case where the indoor unit 2*a* performs the heating operation, the low pressure valve 45*a* is closed, and the high pressure valve 46*a* is open. Similarly, in a case where the indoor unit 2*b* performs the cooling operation, the low pressure valve 45*b* is open, and the high pressure valve 46*b* is closed. In a case where the indoor unit 2*b* performs the heating operation, the low pressure valve 45*b* is closed, and the high pressure valve 46*b* is open.

The controller 3 has a microcomputer including, for example, a central processing unit (CPU), a read-only memory (ROM), a random access memory (RAM), and an input/output (1/O) port. On the basis of, for example, detection signals from various sensors provided in the refrigeration cycle circuit 10 and an operation signal from an operation unit, which is not illustrated, the controller 3 controls operation of the entire refrigeration cycle apparatus including the compressor 11, the refrigerant flow switching device 14, the outdoor fan 13, the electronic expansion valves 21*a* and 21*b*, the indoor fans 25*a* and 25*b*, the low pressure valves 45*a* and 45*b*, and the high pressure valves 46*a* and 46*b*. The controller 3 may be provided in the outdoor unit 1, may be provided in one of the indoor units 2*a* and 2*b*, or may be provided in the branch controller 4.

The controller 3 has a memory unit 31, an extraction unit 32, a calculation unit 33, a comparison unit 34, and a determination unit 35 as functional blocks related to abnormality determinations of the electronic expansion valves 21*a* and 21*b*, the low pressure valves 45*a* and 45*b*, and the high pressure valves 46*a* and 46*b*. The memory unit 31 is configured to store data of pressure detected at each of the high-pressure sensor 15 and the low-pressure sensor 16 and data of temperatures detected at each of the first temperature sensors TH1*a* and TH1*b*, the second temperature sensors TH2*a* and TH2*b*, and the third temperature sensors TH3*a* and TH3*b*. These pieces of data are periodically acquired while the refrigeration cycle circuit 10 is in operation. In addition, various data necessary to perform an abnormality determination are also stored in the memory unit 31.

The extraction unit 32 is configured to extract data to be needed to perform an abnormality determination from the data stored in the memory unit 31. Here, data obtained when the refrigeration cycle circuit 10 and the indoor unit 2*a* operate in a specific operation state are used to perform an abnormality determination of the electronic expansion valve 21*a*, the low pressure valve 45*a*, and the high pressure valve 46*a* corresponding to the indoor unit 2*a*. The specific operation state for when an abnormality determination of the electronic expansion valve 21*a*, the low pressure valve 45*a*, and the high pressure valve 46*a* is performed is an operation state where the compressor 11 operates, the indoor heat exchanger 22*a* functions as an evaporator, and the low pressure valve 45*a* is open while the high pressure valve 46*a* is closed. For example, when the indoor unit 2*a* is in a thermo-on state of the cooling operation, the refrigeration cycle circuit 10 and the indoor unit 2*a* operate in the specific operation state. In this case, either the cooling main operation or the heating main operation may be performed in the refrigeration cycle circuit 10.

Similarly, data obtained when the refrigeration cycle circuit 10 and the indoor unit 2*b* operate in a specific operation state are used to perform an abnormality determination of the electronic expansion valve 21*b*, the low pressure valve 45*b*, and the high pressure valve 46*b* corresponding to the indoor unit 2*b*. The specific operation state for when an abnormality determination of the electronic expansion valve 21*b*, the low pressure valve 45*b*, and the high pressure valve 46*b* is performed is an operation state where the compressor 11 operates, the indoor heat exchanger 22*b* functions as an evaporator, and the low pressure valve 45*b* is open while the high pressure valve 46*b* is closed. For example, when the indoor unit 2*b* is in the thermo-on state of the cooling operation, the refrigeration cycle circuit 10 and the indoor unit 2*b* operate in the specific operation state. In this case, either the cooling main operation or the heating main operation may be performed in the refrigeration cycle circuit 10.

The calculation unit 33 is configured to perform a necessary calculation on the basis of the data extracted by the extraction unit 32.

The comparison unit 34 is configured to compare a value obtained through a calculation performed by the calculation unit 33 with a threshold or compare values obtained through calculations performed by the calculation unit 33 with each other.

The determination unit 35 is configured to perform an abnormality determination of at least one among the electronic expansion valves 21*a* and 21*b*, the low pressure valves 45*a* and 45*b*, and the high pressure valves 46*a* and 46*b* on the basis of a comparison result from the comparison unit 34.

A notification part 36 and an operation mode switching unit 37 are connected to the controller 3. The notification part 36 and the operation mode switching unit 37 may be provided in the controller 3 as a portion of the controller 3. The notification part 36 is configured to issue notification of various types of information such as abnormalities of the electronic expansion valves 21*a* and 21*b*, the low pressure valves 45*a* and 45*b*, and the high pressure valves 46*a* and 46*b* in accordance with a command from the controller 3. The notification part 36 has at least one among a display unit that visually issues notification of information and an audio output unit that acoustically issues notification of information.

The operation mode switching unit 37 is configured to accept an operation mode switching operation performed by the user. When an operation mode switching operation is performed at the operation mode switching unit 37, the operation mode is switched at the controller 3 on the basis of a signal output from the operation mode switching unit 37. The operation modes of the refrigeration cycle apparatus include, for example, a normal operation mode and an abnormality detection mode. In the normal operation mode, the refrigeration cycle apparatus operates in an operation state corresponding to requests from the indoor units 2*a* and 2*b*. For example, in a case where both the indoor units 2*a* and 2*b* request cooling, the cooling only operation is performed. In contrast, in the abnormality detection mode, regardless of requests from the indoor units 2*a* and 2*b*, the indoor unit 2*a* or the indoor unit 2*b* enters the thermo-on state of the cooling operation to perform an operation for detecting an abnormality of the electronic expansion valves 21*a* and 21*b*, the low pressure valves 45*a* and 45*b*, and the high pressure valves 46*a* and 46*b*. Note that even during execution of the normal operation mode, in a case where the indoor unit 2*a* is in the thermo-on state of the cooling operation, an abnormality of the electronic expansion valve 21*a*, the low pressure valve 45*a*, and the high pressure valve 46*a* can be detected. Moreover, even during execution of the normal operation mode, in a case where the indoor unit 2*b* is in the thermo-on state of the cooling operation, an abnormality of the electronic expansion valve 21*b*, the low pressure valve 45*b*, and the high pressure valve 46*b* can be detected.

Next, operation of the refrigeration cycle apparatus will be described by taking the cooling main operation as an example. In a case where the cooling main operation is performed, switching is performed at the refrigerant flow switching device 14 such that the flow path indicated by the solid line in FIG. 1 is formed. In this case, the cooling only operation, in which both the indoor units 2*a* and 2*b* perform the cooling operation, is taken as an example. In a case where the cooling only operation is performed, both the low pressure valves 45*a* and 45*b* are set to be open while both the high pressure valves 46*a* and 46*b* are set to be closed. The electronic expansion valves 21*a* and 21*b* are controlled, for example, such that each of the degrees of superheat at outlets of the indoor heat exchangers 22*a* and 22*b* approaches a target value. In FIG. 1 and FIGS. 3, 5, 7 and 9, which will be described later, out of the low pressure valves 45*a* and 45*b*, the high pressure valves 46*a* and 46*b*, and the electronic expansion valves 21*a* and 21*b*, open valves are represented as hollow valves, and closed valves are represented as filled-in valves.

The high-temperature high-pressure gas refrigerant discharged from the compressor 11 flows into the outdoor heat exchanger 12 via the refrigerant flow switching device 14. At the time of the cooling main operation, the outdoor heat exchanger 12 functions as a condenser. The gas refrigerant that has flowed into the outdoor heat exchanger 12 is condensed through heat exchange with outdoor air supplied by the outdoor fan 13 and turns into high-pressure liquid refrigerant. The refrigerant condensed by the outdoor heat exchanger 12 flows out from the outdoor unit 1 and flows into the gas-liquid separator 43 of the branch controller 4. The gas-liquid separator 43 separates refrigerant flowing thereinto into gas refrigerant and liquid refrigerant. The liquid refrigerant separated at the gas-liquid separator 43 is supplied to the indoor units 2*a* and 2*b* performing the cooling operation. In contrast, since both the high pressure valves 46*a* and 46*b* are closed, refrigerant does not flow from the gas-liquid separator 43 to the bypass flow path 44.

The liquid refrigerant supplied to the indoor unit 2*a* is decompressed by the electronic expansion valve 21*a* to turn into low-pressure two-phase refrigerant, and the low-pressure two-phase refrigerant flows into the indoor heat exchanger 22*a*. The two-phase refrigerant, which has flowed into the indoor heat exchanger 22*a*, evaporates through heat exchange with indoor air supplied by the indoor fan 25*a* and turns into low-pressure gas refrigerant. The indoor air that has passed through the indoor heat exchanger 22*a* turns into cooled conditioned air, and the cooled conditioned air is supplied to the indoor space. The gas refrigerant that has flowed out from the indoor heat exchanger 22*a* passes through the low pressure valve 45*a*, which is open, and is taken into the compressor 11 via the refrigerant flow switching device 14.

Similarly, the liquid refrigerant supplied to the indoor unit 2*b* is decompressed by the electronic expansion valve 21*b* to turn into low-pressure two-phase refrigerant, and the low-pressure two-phase refrigerant flows into the indoor heat exchanger 22*b*. The two-phase refrigerant that has flowed into the indoor heat exchanger 22*b* evaporates through heat exchange with indoor air supplied by the indoor fan 25*b* and turns into low-pressure gas refrigerant. The indoor air that has passed through the indoor heat exchanger 22*b* turns into cooled conditioned air, and the cooled conditioned air is supplied to the indoor space. The gas refrigerant that has flowed out from the indoor heat exchanger 22*b* passes through the low pressure valve 45*b*, which is open, merges with the gas refrigerant that has passed through the low pressure valve 45*a*, and the merged gas refrigerant is taken into the compressor 11.

Constant low pressure control will be described. In the multi-type air-conditioning apparatus as in Embodiment 1, the plurality of indoor units 2*a* and 2*b* need to be operated without causing insufficient performance, and thus the operating frequency of the compressor 11 is controlled such that the low pressure in the refrigeration cycle circuit 10, that is, the suction pressure of the compressor 11 becomes constant. Thus, the evaporation temperature Te, which is calculated using a value of the low pressure, becomes a constant temperature.

Outdoor fan control will be described. At the time of the cooling main operation, the rotation speed of the outdoor fan 13 is controlled such that a temperature difference between a condensing temperature and the outdoor temperature becomes constant.

Regarding steady control at the time of the cooling operation at each of the indoor units 2*a* and 2*b*, description will be made by taking the indoor unit 2*a* as an example. The low pressure is controlled to be constant in the refrigeration cycle circuit 10. Thus, degree-of-superheat control is performed as a method for changing the air conditioning performance of the indoor unit 2*a*. In degree-of-superheat control, a target value of the degree of superheat at the outlet of the indoor heat exchanger 22*a* is adjusted such that the indoor unit 2*a* achieves desired air conditioning performance. A heat exchange amount at the indoor heat exchanger 22*a* changes in accordance with the magnitude of the degree of superheat. Thus, as a result of adjusting the target value of the degree of superheat, the indoor unit 2*a* provides appropriate air conditioning performance. In a case where a temperature difference between a set temperature of the indoor unit 2*a* and the indoor temperature is large, the target value of the degree of superheat is set to a small value. In a case where the temperature difference between the set temperature of the indoor unit 2*a* and the indoor temperature is small, the target value of the degree of superheat is set to a large value. The opening degree of the electronic expansion valve 21*a* is controlled such that the degree of superheat at the outlet of the indoor heat exchanger 22*a* approaches the target value. Consequently, a necessary amount of refrigerant is supplied to the indoor heat exchanger 22*a*.

Next, abnormalities of the electronic expansion valves, the low pressure valves, and the high pressure valves in the refrigeration cycle apparatus according to Embodiment 1 will be described. In the following, a description will be made by taking as examples the electronic expansion valve 21*a*, the indoor heat exchanger 22*a*, the first temperature sensor TH1*a*, the second temperature sensor TH2*a*, the third temperature sensor TH3*a*, the low pressure valve 45*a*, and the high pressure valve 46*a* corresponding to the indoor unit 2*a*.

FIG. 2 is a diagram illustrating an example of combination patterns of states that the electronic expansion valve 21*a*, the low pressure valve 45*a*, and the high pressure valve 46*a* may enter in the refrigeration cycle apparatus according to Embodiment 1. Here, the refrigeration cycle apparatus is controlled to be in the operation state where the compressor 11 operates, the indoor heat exchanger 22*a* functions as an evaporator, and the low pressure valve 45*a* is open while the high pressure valve 46*a* is closed. That is, the indoor unit 2*a* is in the state of performing the cooling operation. To be more precise, the indoor unit 2*a* is in the thermo-on state of the cooling operation. In the refrigeration cycle circuit 10, either the cooling main operation or the heating main operation may be performed.

FIG. 3 is a diagram illustrating operation of the electronic expansion valve 21*a*, the low pressure valve 45*a*, and the high pressure valve 46*a* in a state pattern 1 in the refrigeration cycle apparatus according to Embodiment 1. As illustrated in FIGS. 2 and 3, the state pattern 1 is a state in which all the electronic expansion valve 21*a*, the low pressure valve 45*a*, and the high pressure valve 46*a* are normal. The opening degree of the electronic expansion valve 21*a* is controlled on the basis of the degree of superheat (SH), and the low pressure valve 45*a* is open while the high pressure valve 46*a* is closed. Consequently, the indoor unit 2*a* performs the cooling operation.

FIG. 4 is a graph illustrating a temperature distribution of the refrigerant in the indoor heat exchanger 22*a* in the state pattern 1 in the refrigeration cycle apparatus according to Embodiment 1. The horizontal axis of FIG. 4 represents position in a refrigerant flow path in the indoor heat exchanger 22*a*, and the vertical axis of FIG. 4 represents temperature. The left end of the graph represents a refrigerant inlet of the indoor heat exchanger 22*a* at the time of the cooling operation. The temperature at the left end of the graph corresponds to the liquid-side temperature TH2 of the indoor heat exchanger 22*a* detected by the second temperature sensor TH2*a*. The right end of the graph represents a refrigerant outlet of the indoor heat exchanger 22*a* at the time of the cooling operation. The temperature at the right end of the graph corresponds to the gas-side temperature TH3 of the indoor heat exchanger 22*a* detected by the third temperature sensor TH3*a*.

In the state pattern 1, which is normal, liquid refrigerant is insulated and expanded by the electronic expansion valve 21*a* and turns into low-pressure two-phase refrigerant. The low-pressure two-phase refrigerant absorbs heat at the indoor heat exchanger 22*a* from indoor air to evaporate and turns into superheated gas refrigerant, and the superheated gas refrigerant flows out from the indoor heat exchanger 22*a*. The electronic expansion valve 21*a* is controlled such that the degree of superheat of the indoor heat exchanger 22*a* approaches the target value. From the above, in the state pattern 1, which is normal, two-phase refrigerant flows into the refrigerant inlet of the indoor heat exchanger 22*a*, the refrigerant is changed into superheated gas at a certain portion in the indoor heat exchanger 22*a*, and the temperature of the refrigerant increases as the refrigerant approaches the refrigerant outlet as illustrated in FIG. 4. The superheated gas refrigerant flows out from the refrigerant outlet of the indoor heat exchanger 22*a*. Thus, the liquid-side temperature TH2 becomes almost the same as the evaporation temperature Te, which is calculated using the low pressure, (TH2=Te). In addition, the gas-side temperature TH3 becomes the temperature of the superheated gas refrigerant higher than the evaporation temperature Te (TH3>Te).

Figure 5:
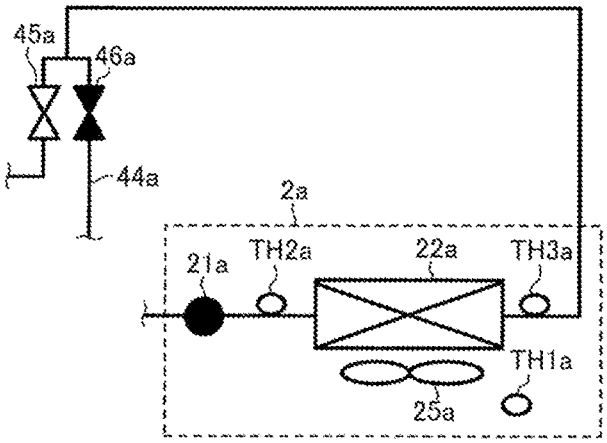
FIG. 5 is a diagram illustrating operation of the electronic expansion valve 21*a*, the low pressure valve 45*a*, and the high pressure valve 46*a* in a state pattern 2 in the refrigeration cycle apparatus according to Embodiment 1 of the present disclosure.

FIG. 5 is a diagram illustrating operation of the electronic expansion valve 21*a*, the low pressure valve 45*a*, and the high pressure valve 46*a* in a state pattern 2 in the refrigeration cycle apparatus according to Embodiment 1. As illustrated in FIGS. 2 and 5, the state pattern 2 is a state in which the electronic expansion valve 21*a* is locked closed. For the electronic expansion valve 21*a*, being locked closed is one of abnormalities of the electronic expansion valve 21*a* and is a state in which the electronic expansion valve 21*a* is fixed in a closed state due to locking of the valve disc in the electronic expansion valve 21*a*. The electronic expansion valve 21*a* is controlled on the basis of the degree of superheat in the state pattern 1, which is normal, while the electronic expansion valve 21*a* is caused to maintain the closed state in the state pattern 2.

Figure 6:
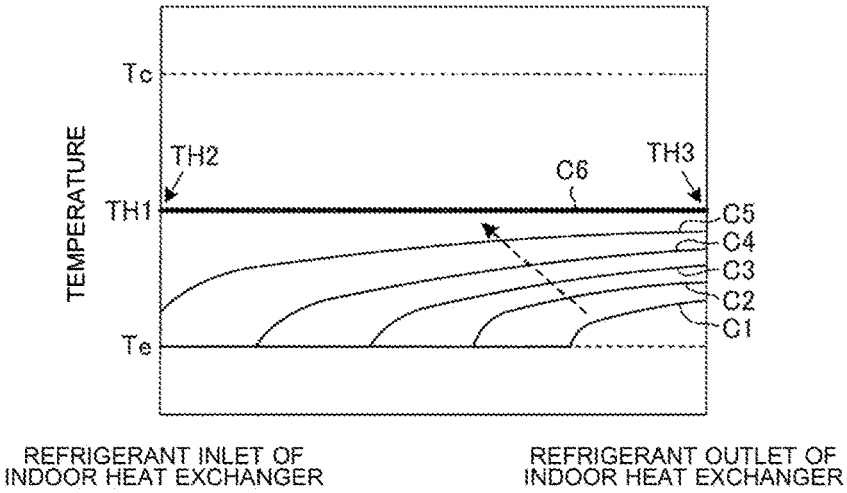
FIG. 6 is a graph illustrating a temperature distribution of the refrigerant in the indoor heat exchanger 22*a* in the state pattern 2 in the refrigeration cycle apparatus according to Embodiment 1 of the present disclosure.

FIG. 6 is a graph illustrating a temperature distribution of the refrigerant in the indoor heat exchanger 22*a* in the state pattern 2 in the refrigeration cycle apparatus according to Embodiment 1. The vertical and horizontal axes of FIG. 6 are substantially the same as those of FIG. 4. A curved bold solid line C6 represents a temperature distribution of the refrigerant in a case where sufficient time has elapsed after the state pattern changed from the state pattern 1 to the state pattern 2. A curved thin solid line C1 represents a temperature distribution of the refrigerant soon after the state pattern changed from the state pattern 1 to the state pattern 2. Curved thin solid lines C2, C3, C4, and C5 chronologically represent changes in refrigerant temperature distribution from the temperature distribution represented by the curved line C1 to the temperature distribution represented by the curved line C6.

When the electronic expansion valve 21*a* is locked closed, and the state pattern 2 occurs, refrigerant does not flow into the indoor heat exchanger 22*a*. Thus, the two-phase refrigerant that is already in the indoor heat exchanger 22*a* is gradually changed into superheated gas through heat exchange with indoor air. Consequently, as illustrated in FIG. 6, the gas-side temperature TH3 gradually increases and eventually becomes almost the same as the indoor temperature TH1 (TH3=TH1). The liquid-side temperature TH2 remains at almost the same temperature as the evaporation temperature Te while liquid refrigerant is present in the indoor heat exchanger 22*a*, gradually increases when all the liquid refrigerant is changed into gas, and eventually becomes almost the same temperature as the indoor temperature TH1 (TH2=TH1). That is, after a predetermined period of time has elapsed since the state pattern became the state pattern 2, both the liquid-side temperature TH2 and the gas-side temperature TH3 become almost the same temperature as the indoor temperature TH1 (TH2=TH3=TH1).

Figure 7:
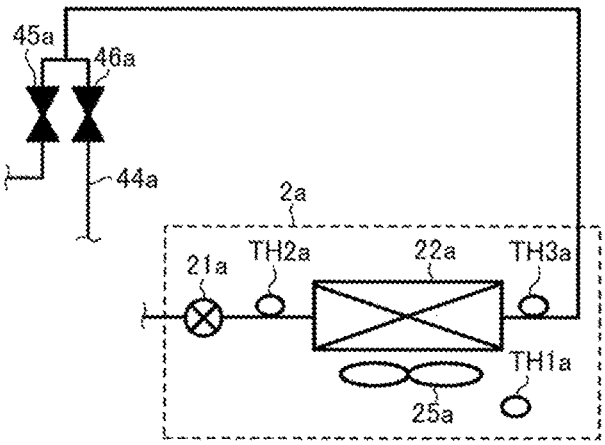
FIG. 7 is a diagram illustrating operation of the electronic expansion valve 21*a*, the low pressure valve 45*a*, and the high pressure valve 46*a* in a state pattern 3 in the refrigeration cycle apparatus according to Embodiment 1 of the present disclosure.

FIG. 7 is a diagram illustrating operation of the electronic expansion valve 21*a*, the low pressure valve 45*a*, and the high pressure valve 46*a* in a state pattern 3 in the refrigeration cycle apparatus according to Embodiment 1. As illustrated in FIGS. 2 and 7, the state pattern 3 is a state in which the low pressure valve 45*a* is locked closed. For the low pressure valve 45*a*, being locked closed is one of abnormalities of the low pressure valve 45*a* and is a state in which the low pressure valve 45*a* is fixed in a closed state due to locking of the valve disc in the low pressure valve 45*a*. The low pressure valve 45*a* is open in the state pattern 1, which is normal, while the low pressure valve 45*a* is closed in the state pattern 3. When the indoor unit 2*a* is switched from the heating operation to the cooling operation, if the low pressure valve 45*a* is locked closed, the low pressure valve 45*a* does not enter an open state. Consequently, the state pattern becomes the state pattern 3, not the state pattern 1.

Figure 8:
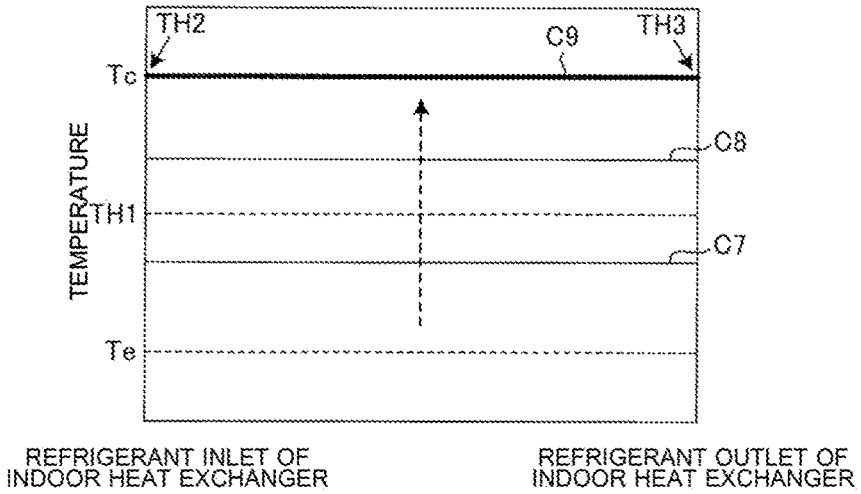
FIG. 8 is a graph illustrating a temperature distribution of the refrigerant in the indoor heat exchanger 22*a* in the state pattern 3 in the refrigeration cycle apparatus according to Embodiment 1 of the present disclosure.

FIG. 8 is a graph illustrating a temperature distribution of the refrigerant in the indoor heat exchanger 22*a* in the state pattern 3 in the refrigeration cycle apparatus according to Embodiment 1. The vertical and horizontal axes of FIG. 8 are substantially the same as those of FIG. 4. A curved bold solid line C9 represents a temperature distribution of the refrigerant in a case where sufficient time has elapsed after the state pattern became the state pattern 3. Curved thin solid lines C7 and C8 chronologically represent changes in refrigerant temperature distribution to the temperature distribution represented by the curved line C9.

When the low pressure valve 45*a* is locked closed, and the state pattern 3 occurs, the refrigerant in the indoor heat exchanger 22*a* cannot flow out toward the outdoor unit 1 nor toward the branch controller 4, and thus liquid refrigerant accumulates in the indoor heat exchanger 22*a*. Since liquid refrigerant accumulates in the indoor heat exchanger 22*a*, the degree of superheat at the outlet of the indoor heat exchanger 22*a* decreases and approaches 0. Consequently, the opening degree of the electronic expansion valve 21*a* is controlled in a higher opening degree range, and thus the amount of refrigerant flowing into the indoor heat exchanger 22*a* increases, and the pressure inside the indoor heat exchanger 22*a* increases. When the inside of the indoor heat exchanger 22*a* is filled with liquid refrigerant in the end, both the liquid-side temperature TH2 and the gas-side temperature TH3 become almost the same temperature as the condensing temperature Tc (TH2=TH3=Tc>TH1).

Here, before describing a state pattern 4, the state patterns 2 and 3 will be collectively described. In both the state patterns 2 and 3, the liquid-side temperature TH2 becomes higher than the evaporation temperature Te (TH2>Te). Thus, in a case where the liquid-side temperature TH2 becomes higher than the evaporation temperature Te, it can be determined that the state pattern is the state pattern 2 or the state pattern 3. That is, in a case where the liquid-side temperature TH2 becomes higher than the evaporation temperature Te, it can be determined that either the electronic expansion valve 21*a* or the low pressure valve 45*a* is abnormal. In this case, the notification part 36 may issue notification that either the electronic expansion valve 21*a* or the low pressure valve 45*a* is abnormal.

Changes in the liquid-side temperature TH2 after the liquid-side temperature TH2 becomes higher than the evaporation temperature Te in the state pattern 2 differ from those in the state pattern 3. As illustrated in FIG. 6, the liquid-side temperature TH2 in the state pattern 2 monotonically increases from the evaporation temperature Te to the indoor temperature TH1 and becomes almost the same temperature as the indoor temperature TH1 after a predetermined time has elapsed. That is, the liquid-side temperature TH2 in the state pattern 2 changes within a temperature range higher than the evaporation temperature Te and less than or equal to the indoor temperature TH1 (Te<TH2 TH1). In contrast, as illustrated in FIG. 8, the liquid-side temperature TH2 in the state pattern 3 monotonically increases from the evaporation temperature Te to the condensing temperature Tc and becomes almost the same temperature as the condensing temperature Tc after a predetermined time has elapsed. That is, the liquid-side temperature TH2 in the state pattern 3 changes within a temperature range higher than the evaporation temperature Te and less than or equal to the condensing temperature Tc (Te<TH2≤Tc).

The liquid-side temperature TH2 in the state pattern 2 can change up to the indoor temperature TH1 and becomes stable at the indoor temperature TH1. In contrast, the liquid-side temperature TH2 in the state pattern 3 can change up to the condensing temperature Tc, which is higher than the indoor temperature TH1 (Tc>TH1), and becomes stable at the condensing temperature Tc. Thus, in a case where the liquid-side temperature TH2 becomes higher than the indoor temperature TH1 (TH1<TH2 Tc), it can be determined that the state pattern is not the state pattern 2 but the state pattern 3. That is, in a case where the liquid-side temperature TH2 becomes higher than TH1, it can be determined that the low pressure valve 45*a* is abnormal.

Since the liquid-side temperature TH2 in the state pattern 3 monotonically increases to the condensing temperature Tc, the liquid-side temperature TH2 becomes higher than the indoor temperature TH1 after a certain period of time has elapsed. In contrast, the liquid-side temperature TH2 in the state pattern 2 does not become higher than the indoor temperature TH1. Thus, in a case where the liquid-side temperature TH2 is higher than the evaporation temperature Te and is less than or equal to the indoor temperature TH1 after a predetermined period of time has elapsed, it can be determined that the state pattern is not the state pattern 3 but the state pattern 2. That is, in a case where the liquid-side temperature TH2 is higher than the evaporation temperature Te and is less than or equal to the indoor temperature TH1 after a predetermined period of time has elapsed, it can be determined that the electronic expansion valve 21*a* is abnormal.

Figure 9:
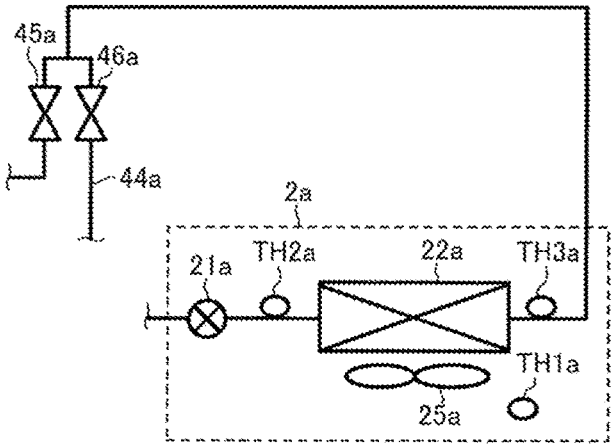
FIG. 9 is a diagram illustrating operation of the electronic expansion valve 21*a*, the low pressure valve 45*a*, and the high pressure valve 46*a* in a state pattern 4 in the refrigeration cycle apparatus according to Embodiment 1 of the present disclosure.

FIG. 9 is a diagram illustrating operation of the electronic expansion valve 21*a*, the low pressure valve 45*a*, and the high pressure valve 46*a* in the state pattern 4 in the refrigeration cycle apparatus according to Embodiment 1. As illustrated in FIGS. 2 and 9, the state pattern 4 is a state in which the high pressure valve 46*a* is locked open. For the high pressure valve 46*a*, being locked open is one of abnormalities of the high pressure valve 46*a* and is a state in which the high pressure valve 46*a* is fixed in an open state due to locking of the valve disc in the high pressure valve 46*a*. The high pressure valve 46*a* is closed in the state pattern 1, which is normal, while the high pressure valve 46*a* is open in the state pattern 4. When the indoor unit 2*a* is switched from the heating operation to the cooling operation, if the high pressure valve 46*a* is locked open, the high pressure valve 46*a* does not enter a closed state. Consequently, the state pattern becomes the state pattern 4, not the state pattern 1.

Figure 10:
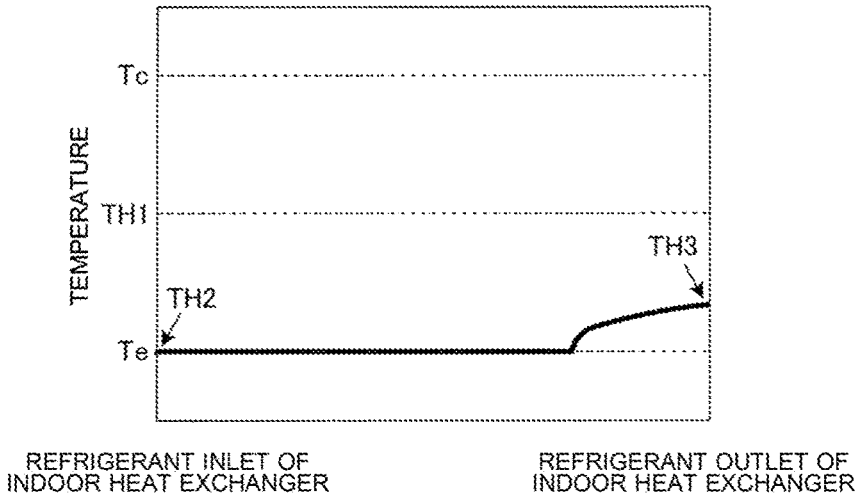
FIG. 10 is a graph illustrating a temperature distribution of the refrigerant in the indoor heat exchanger 22*a* in the state pattern 4 in the refrigeration cycle apparatus according to Embodiment 1 of the present disclosure.

FIG. 10 is a graph illustrating a temperature distribution of the refrigerant in the indoor heat exchanger 22*a* in the state pattern 4 in the refrigeration cycle apparatus according to Embodiment 1. The vertical and horizontal axes of FIG. 10 are substantially the same as those of FIG. 4. As illustrated in FIG. 10, the temperature distribution of the refrigerant in the state pattern 4 is substantially the same as, for example, that of the refrigerant in the state pattern 1, which is normal.

Since the high pressure valve 46*a* is open in the state pattern 4, a portion of high-pressure refrigerant flows into the low-pressure side of the refrigeration cycle circuit 10 through the bypass flow path 44 and the branch flow path 44*a*. Consequently, a low pressure Ps in the refrigeration cycle circuit 10 increases. The compressor 11 is controlled such that the low pressure Ps approaches a target pressure Psm, which is constant, and thus as the low pressure Ps increases, the operating frequency of the compressor 11 increases. That is, the amount of refrigerant passing through the compressor 11 increases by the amount of refrigerant flowing through the bypass flow path 44. In a case where the low pressure Ps in the refrigeration cycle circuit 10 can be maintained at the target pressure Psm due to an increase in the operating frequency of the compressor 11, although the operating efficiency of the refrigeration cycle apparatus decreases, the indoor unit 2*a* may operate similarly to as in the state pattern 1, which is normal, as illustrated in FIG. 10. In contrast, since the range of operating frequencies is set in the compressor 11, the operating frequency of the compressor 11 cannot be made higher than the maximum operating frequency, which is the upper limit of the range of operating frequencies. In a case where the low pressure Ps in the refrigeration cycle circuit 10 cannot be maintained at the target pressure Psm even when the operating frequency of the compressor 11 is increased to the maximum operating frequency, the performance of the indoor unit 2*a* decreases due to an increase in the low pressure Ps.

In the state pattern 4, a portion of refrigerant discharged from the compressor 11 is not supplied to any of the indoor units 2*a* and 2*b* and flows through the bypass flow path 44. Thus, it can be determined whether the state pattern is the state pattern 4 by comparing the amount of refrigerant passing through the compressor 11 with the total sum of the amounts of refrigerant passing through the respective electronic expansion valves 21*a* and 21*b* of both the indoor units 2*a* and 2*b*. An amount Groc of refrigerant passing through the compressor 11 can be calculated using, for example, the operating frequency of the compressor 11 and the density of refrigerant to be taken into the compressor 11. The following Equation (1) is an example of an equation to calculate the amount Groc of refrigerant passing through the compressor 11.

$$Groc = Vst \times F \times \rho s \times \eta v \quad (1)$$

Groc: the amount [kg/s] of refrigerant passing through the compressor 11

Vst: the discharge amount [$m^3$] of the compressor 11

F: the operating frequency [Hz] of the compressor 11

ρs: the density [$kg/m^3$] of refrigerant to be taken into the compressor 11

ηv: the volumetric efficiency of the compressor 11 (constant)

A total sum ΣGric of the amounts of refrigerant passing through the respective electronic expansion valves 21*a* and 21*b* is the total sum of an amount Gric of refrigerant passing through the electronic expansion valve 21*a* and an amount Gric of refrigerant passing through the electronic expansion valve 21*b*. For example, the amount Gric of refrigerant passing through the electronic expansion valve 21*a* can be calculated using, for example, the difference in pressure between the high pressure and the low pressure in the refrigeration cycle circuit 10 and a Cv value of the electronic expansion valve 21*a*. The following Equation (2) is an example of an equation to calculate the amount Gric of refrigerant passing through the electronic expansion valve 21*a*.

$$Gric = 86.4 \times Cv \times \sqrt{(\Delta P \times \mu LEV)}/3600 \quad (2)$$

Gric: the amount [kg/s] of refrigerant passing through the electronic expansion valve 21*a*

Cv: the Cv value of the electronic expansion valve 21*a*

ΔP: the difference in pressure [MPa] between the high pressure and the low pressure in the refrigeration cycle circuit 10

μLEV: the density [$kg/m^3$] of refrigerant at the inlet of the electronic expansion valve 21*a*

In a case where the amount Groc of refrigerant passing through the compressor 11 is greater than the total sum ΣGric of the amounts of refrigerant passing through the respective electronic expansion valves 21*a* and 21*b* (Groc>ΣGric), it can be determined that the state pattern is the state pattern 4. Here, in a case where refrigerant discharged from the compressor 11 is supplied to only one indoor unit, which is the indoor unit 2*a*, whether the state pattern is the state pattern 4 can be determined using the amount Groc of refrigerant passing through the compressor 11 and the amount Gric of refrigerant passing through the electronic expansion valve 21*a*. That is, in a case where the amount Groc of refrigerant passing through the compressor 11 is greater than the amount Gric of refrigerant passing through the electronic expansion valve 21*a* (Groc>Gric), it can be determined that the state pattern is the state pattern 4.

In addition, in a case where the value obtained by subtracting the target pressure Psm from the low pressure Ps in the refrigeration cycle circuit 10 is greater than a threshold, it can also be determined that the state pattern is the state pattern 4. Alternatively, in a case where the value obtained by subtracting the target pressure Psm from the low pressure Ps in the refrigeration cycle circuit 10 is greater than a threshold and the compressor 11 operates at the maximum operating frequency, it can also be determined that the state pattern is the state pattern 4. The thresholds are set to, for example, values greater than the absolute value of a margin of error in the low pressure Ps under constant low pressure control.

Next, regarding abnormality detection of at least one among the low pressure valve 45*a*, the high pressure valve 46*a*, and the electronic expansion valve 21*a*, processing performed at the controller 3 will be described. The controller 3 repeatedly executes at least one process among abnormality detection processes illustrated in FIGS. 11 to 13 at predetermined time intervals. Here, a process for detecting an abnormality of the low pressure valve 45*a*, the high pressure valve 46*a*, or the electronic expansion valve 21*a* will be described; however, a process for detecting an abnormality of the low pressure valve 45*b*, the high pressure valve 46*b*, or the electronic expansion valve 21*b* is executed in substantially the same manner.

Figure 11:
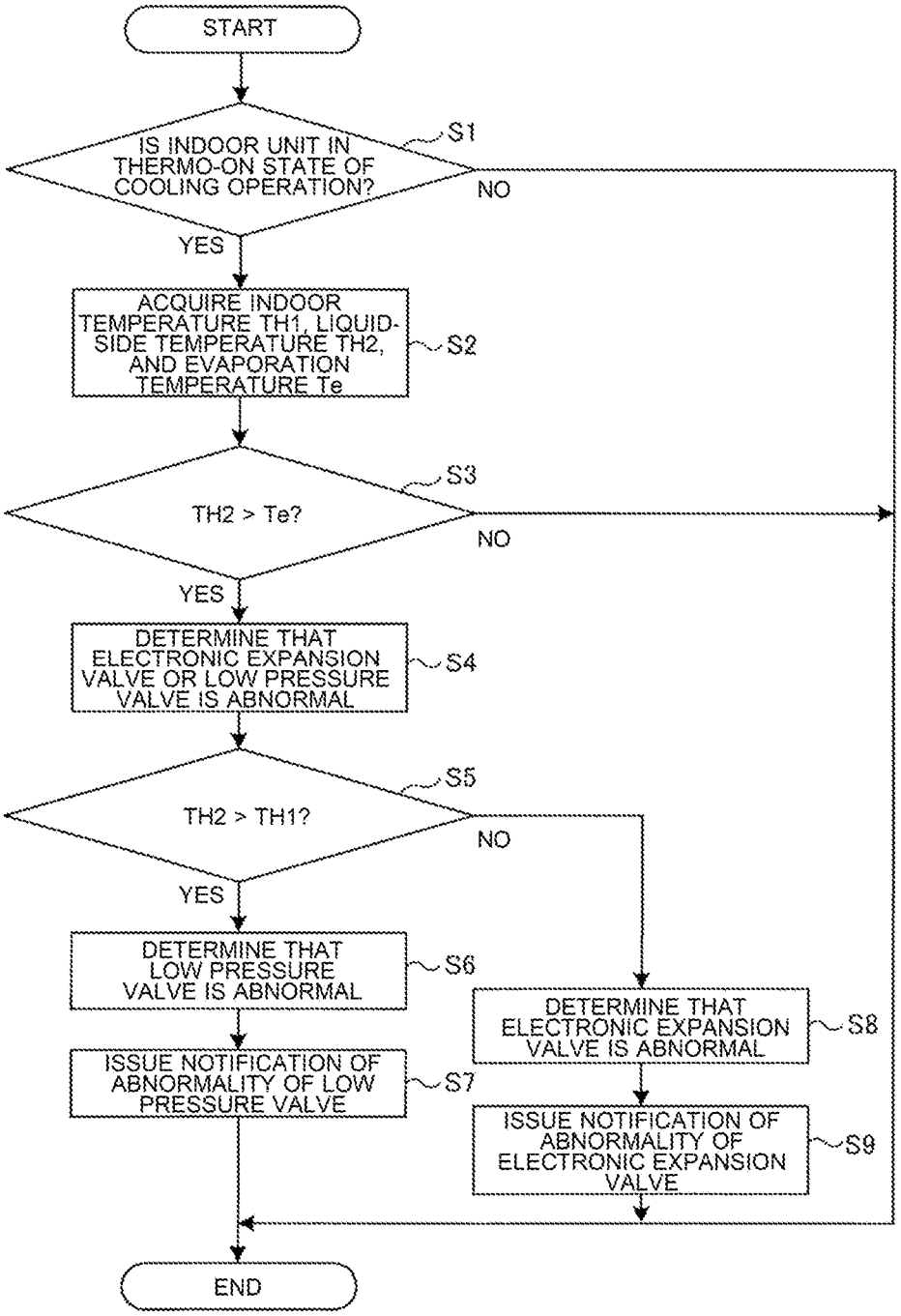
FIG. 11 is a flow chart illustrating an example of the procedure of a first abnormality detection process executed by a controller 3 of the refrigeration cycle apparatus according to Embodiment 1 of the present disclosure.

FIG. 11 is a flow chart illustrating an example of the procedure of a first abnormality detection process executed by the controller 3 of the refrigeration cycle apparatus according to Embodiment 1. In the first abnormality detection process, an operation for detecting an abnormality of the low pressure valve 45*a* and the electronic expansion valve 21*a* is performed. In the flow chart illustrated in FIG. 11, abnormality detection processing for the low pressure valve 45*a* and the electronic expansion valve 21*a* is performed in a single procedure; however, abnormality detection processing for the low pressure valve 45*a* and that for the electronic expansion valve 21*a* may be performed in separate procedures.

First, the controller 3 determines whether the indoor unit 2*a* is in the thermo-on state of the cooling operation (step S1). This determination can also translate to a determination as to whether the state is the operation state where the compressor 11 operates, the indoor heat exchanger 22*a* functions as an evaporator, and the low pressure valve 45*a* is open while the high pressure valve 46*a* is closed. In a case where the indoor unit 2*a* is in the thermo-on state of the cooling operation, the process proceeds to step S2. In the other cases, the first abnormality detection process ends.

In step S2, the controller 3 acquires data of each of the indoor temperature TH1, the liquid-side temperature TH2, and the evaporation temperature Te. The data of the indoor temperature TH1 is acquired on the basis of a detection signal from the first temperature sensor TH1*a*. The data of the liquid-side temperature TH2 is acquired on the basis of a detection signal from the second temperature sensor TH2*a*. The data of the evaporation temperature Te is acquired on the basis of a detection signal from the low-pressure sensor 16. Moreover, the controller 3 acquires data of each of the gas-side temperature TH3 and the condensing temperature Tc as needed. The data of the gas-side temperature TH3 is acquired on the basis of a detection signal from the third temperature sensor TH3*a*. The data of the condensing temperature Tc is acquired on the basis of a detection signal from the high-pressure sensor 15.

Next, in step S3, the controller 3 determines whether the liquid-side temperature TH2 is higher than the evaporation temperature Te. In a case where the liquid-side temperature TH2 is higher than the evaporation temperature Te, the process proceeds to step S4. In a case where the liquid-side temperature TH2 is less than or equal to the evaporation temperature Te, the first abnormality detection process ends.

In step S4, the controller 3 determines that the electronic expansion valve 21*a* or the low pressure valve 45*a* is abnormal. This is because the state pattern corresponds not to the state pattern 1, which is normal, but to the state pattern 2 or 3 in a case where the liquid-side temperature TH2 is higher than the evaporation temperature Te. Here, processing in step S4 can be omitted.

Next, in step S5, the controller 3 determines whether the liquid-side temperature TH2 is higher than the indoor temperature TH1. In a case where the liquid-side temperature TH2 is higher than the indoor temperature TH1, the process proceeds to step S6. In a case where the liquid-side temperature TH2 is less than or equal to the indoor temperature TH1, the process proceeds to step S8. Here, a determination in step S5 may be performed after the length of time elapsed from when the determination was made in step S3 exceeds a preset time threshold, that is, after the liquid-side temperature TH2 becomes stable.

In step S6, the controller 3 determines that the low pressure valve 45*a* is abnormal. This is because the state pattern corresponds to the state pattern 3 in a case where the liquid-side temperature TH2 is higher than the indoor temperature TH1.

Next, in step S7, the controller 3 performs processing for causing the notification part 36 to issue notification that the low pressure valve 45*a* is abnormal. Thereafter, the first abnormality detection process ends.

In step S8, the controller 3 determines that the electronic expansion valve 21*a* is abnormal. This is because the state pattern corresponds to the state pattern 2 in a case where the liquid-side temperature TH2 is higher than the evaporation temperature Te and is less than or equal to the indoor temperature TH1.

Next, in step S9, the controller 3 performs processing for causing the notification part 36 to issue notification that the electronic expansion valve 21*a* is abnormal. Thereafter, the first abnormality detection process ends.

As a result of executing the first abnormality detection process as described above by the controller 3, in a case where the liquid-side temperature TH2 is higher than the evaporation temperature Te, the notification part 36 issues notification of an abnormality of the electronic expansion valve 21*a*, or the notification part 36 issues notification of an abnormality of the low pressure valve 45*a*.

Figure 12:
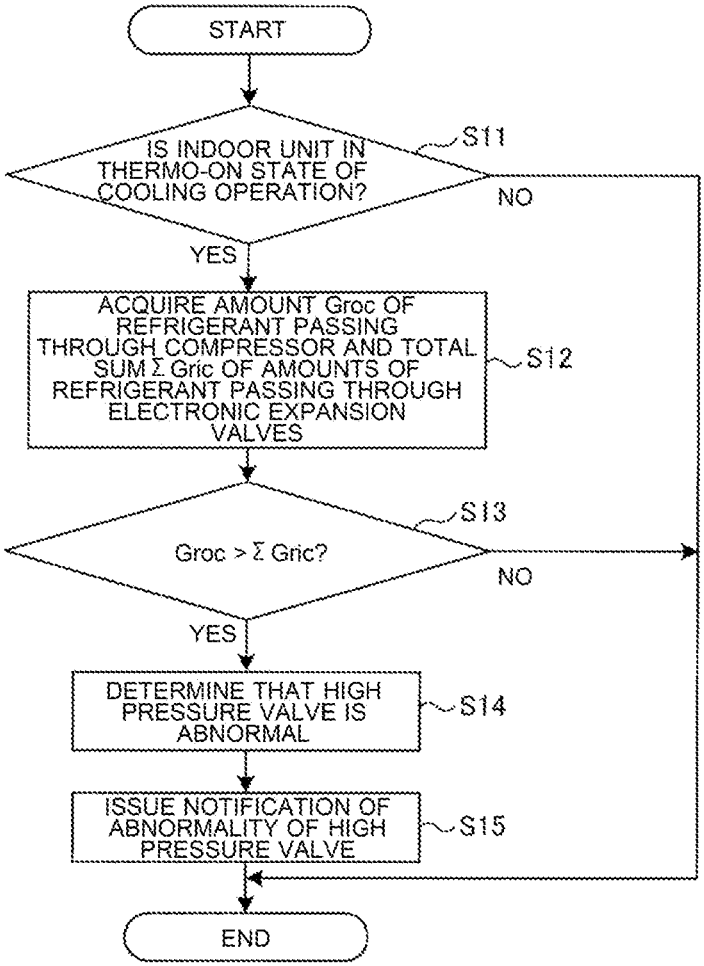
FIG. 12 is a flow chart illustrating an example of the procedure of a second abnormality detection process executed by the controller 3 of the refrigeration cycle apparatus according to Embodiment 1 of the present disclosure.

FIG. 12 is a flow chart illustrating an example of the procedure of a second abnormality detection process executed by the controller 3 of the refrigeration cycle apparatus according to Embodiment 1. In the second abnormality detection process, an operation for detecting an abnormality of the high pressure valve 46*a* is performed. Here, the second abnormality detection process illustrated in FIG. 12 or a second abnormality detection process illustrated in FIG. 13, which will be described later, may be executed in a single procedure together with the first abnormality detection process illustrated in FIG. 11.

First, the controller 3 determines whether the indoor unit 2*a* is in the thermo-on state of the cooling operation (step S11). This determination can also translate to a determination as to whether the state is the operation state where the compressor 11 operates, the indoor heat exchanger 22*a* functions as an evaporator, and the low pressure valve 45*a* is open while the high pressure valve 46*a* is closed. In a case where the indoor unit 2*a* is in the thermo-on state of the cooling operation, the process proceeds to step S12. In the other cases, the second abnormality detection process ends.

Next, in step S12, the controller 3 acquires data of the amount Groc of refrigerant passing through the compressor 11 and data of the total sum ΣGric of the amounts of refrigerant passing through the respective electronic expansion valves 21*a* and 21*b*. The data of the amount Groc of refrigerant in the outdoor unit 1 is acquired on the basis of, for example, Equation (1) described above. The data of the total sum ΣGric of the amounts of refrigerant in the indoor units 2*a* and 2*b* is acquired on the basis of, for example, Equation (2) described above.

Next, in step S13, the controller 3 determines whether the amount Groc of refrigerant in the outdoor unit 1 is greater than the total sum ΣGric of the amounts of refrigerant in the indoor units 2*a* and 2*b*. In a case where the amount Groc of the refrigerant is greater than the total sum ΣGric of the amounts of the refrigerant, the process proceeds to step S14. In a case where the amount Groc of the refrigerant is equal to the total sum ΣGric of the amounts of the refrigerant, the second abnormality detection process ends.

In step S14, the controller 3 determines that the high pressure valve 46*a* is abnormal. This is because the state pattern corresponds to the state pattern 4 in a case where the amount Groc of the refrigerant in the outdoor unit 1 is greater than the total sum ΣGric of the amounts of the refrigerant in the indoor units 2*a* and 2*b*.

Next, in step S15, the controller 3 performs processing for causing the notification part 36 to issue notification that the high pressure valve 46*a* is abnormal. Thereafter, the second abnormality detection process ends.

Figure 13:
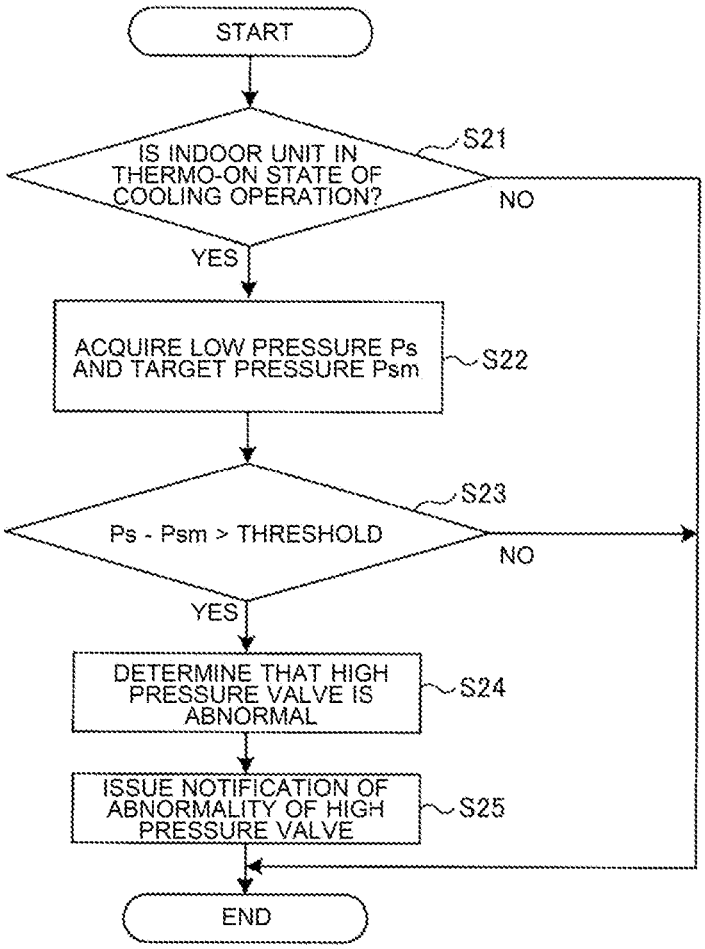
FIG. 13 is a flow chart illustrating another example of the procedure of the second abnormality detection process executed by the controller 3 of the refrigeration cycle apparatus according to Embodiment 1 of the present disclosure.

FIG. 13 is a flow chart illustrating another example of the procedure of the second abnormality detection process executed by the controller 3 of the refrigeration cycle apparatus according to Embodiment 1.

First, the controller 3 determines whether the indoor unit 2*a* is in the thermo-on state of the cooling operation (step S21). In a case where the indoor unit 2*a* is in the thermo-on state of the cooling operation, the process proceeds to step S22. In the other cases, the second abnormality detection process ends.

In step S22, the controller 3 acquires data of each of the low pressure Ps and the target pressure Psm. The data of the low pressure Ps is acquired on the basis of a detection signal from the low-pressure sensor 16. The data of the target pressure Psm is stored in advance in the memory unit 31.

Next, in step S23, the controller 3 determines whether the value (Ps−Psm) obtained by subtracting the target pressure Psm from the low pressure Ps is greater than a preset threshold. In a case where the value obtained by subtracting the target pressure Psm from the low pressure Ps is greater than the threshold, the process proceeds to step S24. In a case where the value obtained by subtracting the target pressure Psm from the low pressure Ps is less than or equal to the threshold, the second abnormality detection process ends.

In step S24, the controller 3 determines that the high pressure valve 46*a* is abnormal. This is because the state pattern corresponds to the state pattern 4 in a case where the value obtained by subtracting the target pressure Psm from the low pressure Ps is greater than the threshold.

Next, in step S25, the controller 3 performs processing for causing the notification part 36 to issue notification that the high pressure valve 46*a* is abnormal. Thereafter, the second abnormality detection process ends.

Here, in step S23 described above, the controller 3 may determine whether the value obtained by subtracting the target pressure Psm from the low pressure Ps is greater than a threshold and whether the compressor 11 operates at the maximum operating frequency. In this case, in a case where the value obtained by subtracting the target pressure Psm from the low pressure Ps is greater than the threshold and where the compressor 11 operates at the maximum operating frequency, the process proceeds to step S24. In a case where the value obtained by subtracting the target pressure Psm from the low pressure Ps is less than or equal to the threshold or where the compressor 11 operates at an operating frequency less than the maximum operating frequency, the second abnormality detection process ends.

As described above, the refrigeration cycle apparatus according to Embodiment 1 includes the refrigeration cycle circuit 10, the bypass flow path 44, the low pressure valve 45*a*, the high pressure valve 46*a*, the first temperature sensor TH1*a*, the second temperature sensor TH2*a*, and the notification part 36. The refrigeration cycle circuit 10 has the compressor 11, the refrigerant flow switching device 14, the outdoor heat exchanger 12, the electronic expansion valve 21*a*, and the indoor heat exchanger 22*a*. The bypass flow path 44 connects the first branch part 41 provided between the outdoor heat exchanger 12 and the electronic expansion valve 21*a* in the refrigeration cycle circuit 10 to the second branch part 42*a* provided between the indoor heat exchanger 22*a* and the refrigerant flow switching device 14 in the refrigeration cycle circuit 10. The low pressure valve 45*a* is provided between the second branch part 42*a* and the refrigerant flow switching device 14 in the refrigeration cycle circuit 10. The high pressure valve 46*a* is provided at the bypass flow path 44. The first temperature sensor TH1*a* detects the temperature TH1 of the indoor space to which air that has passed through the indoor heat exchanger 22*a* is supplied. The second temperature sensor TH2*a* detects the temperature TH2 of refrigerant on the liquid side of the indoor heat exchanger 22*a*. The notification part 36 is configured to perform abnormality notification. The refrigeration cycle apparatus is able to operate in the operation state in which the compressor 11 operates, the indoor heat exchanger 22*a* functions as an evaporator, and the low pressure valve 45*a* is open while the high pressure valve 46*a* is closed. In the operation state, the notification part 36 issues notification of an abnormality of the electronic expansion valve 21*a* or the low pressure valve 45*a* when the temperature TH2 detected by the second temperature sensor TH2*a* is higher than the evaporation temperature Te of refrigerant in the refrigeration cycle circuit 10. Here, the low pressure valve 45*a* is an example of the first valve. The high pressure valve 46*a* is an example of the second valve. The electronic expansion valve 21*a* is an example of the expansion device.

When an abnormality occurs in the electronic expansion valve 21*a* or the low pressure valve 45*a* in the operation state, the temperature TH2 detected by the second temperature sensor TH2*a* becomes higher than the evaporation temperature Te as illustrated in FIGS. 6 and 8. Thus, with the configuration described above, an abnormality of the electronic expansion valve 21*a* or the low pressure valve 45*a* can be detected more accurately and earlier. Moreover, with the configuration described above, notification of an abnormality of the electronic expansion valve 21*a* or the low pressure valve 45*a* can be issued earlier, and thus the electronic expansion valve 21*a* or the low pressure valve 45*a* can be restored earlier. Thus, with the configuration described above, a malfunction period of the indoor unit 2*a* can be shortened.

In the refrigeration cycle apparatus according to Embodiment 1, in the operation state, the notification part 36 issues notification of an abnormality of the low pressure valve 45*a* when the temperature TH2 detected by the second temperature sensor TH2*a* is higher than the temperature TH1 detected by the first temperature sensor TH1*a*.

When an abnormality occurs in the low pressure valve 45*a* in the operation state, the temperature TH2 detected by the second temperature sensor TH2*a* reaches a temperature higher than the temperature TH1 detected by the first temperature sensor TH1*a* as illustrated in FIG. 8. Thus, with the configuration described above, an abnormality of the low pressure valve 45*a* can be detected more accurately. Moreover, with the configuration described above, notification of an abnormality of the low pressure valve 45*a* can be issued earlier, and thus the low pressure valve 45*a* can be restored earlier. Thus, with the configuration described above, a malfunction period of the indoor unit 2*a* can be shortened.

In the refrigeration cycle apparatus according to Embodiment 1, in the operation state, the notification part 36 issues notification of an abnormality of the electronic expansion valve 21*a* when the temperature TH2 detected by the second temperature sensor TH2*a* is higher than the evaporation temperature Te of refrigerant in the refrigeration cycle circuit 10 and is less than or equal to the temperature TH1 detected by the first temperature sensor TH1*a*.

When an abnormality occurs in the electronic expansion valve 21*a* in the operation state, the temperature TH2 detected by the second temperature sensor TH2*a* gradually increases from the evaporation temperature Te and reaches a temperature almost the same as the temperature TH1 detected by the first temperature sensor TH1*a* as illustrated in FIG. 6. Thus, with the configuration described above, an abnormality of the electronic expansion valve 21*a* can be detected more accurately.

In the refrigeration cycle apparatus according to Embodiment 1, in the operation state, the notification part 36 issues notification of an abnormality of the high pressure valve 46*a* when the amount of refrigerant passing through the compressor 11 is greater than the amount of refrigerant passing through the electronic expansion valve 21*a*.

When an abnormality occurs in the high pressure valve 46*a* in the operation state, a portion of high-pressure refrigerant passes through the bypass flow path 44 and flows into the low-pressure side of the refrigeration cycle circuit 10, and thus the amount of refrigerant passing through the compressor 11 becomes greater than the amount of refrigerant passing through the electronic expansion valve 21*a*. Thus, with the configuration described above, an abnormality of the high pressure valve 46*a* can be detected more accurately.

In the refrigeration cycle apparatus according to Embodiment 1, the compressor 11 is controlled such that the low pressure Ps in the refrigeration cycle circuit 10 approaches the target pressure Psm. In the operation state, the notification part 36 issues notification of an abnormality of the high pressure valve 46*a* when the value obtained by subtracting the target pressure Psm from the low pressure Ps is greater than the threshold.

When an abnormality occurs in the high pressure valve 46*a* in the operation state, a portion of high-pressure refrigerant passes through the bypass flow path 44 and flows into the low-pressure side of the refrigeration cycle circuit 10, and thus the low pressure Ps increases, and a difference occurs between the low pressure Ps and the target pressure Psm. Thus, with the configuration described above, an abnormality of the high pressure valve 46*a* can be detected more accurately. Moreover, with the configuration described above, notification of an abnormality of the high pressure valve 46*a* can be issued earlier, and thus the high pressure valve 46*a* can be restored earlier. Thus, with the configuration described above, a period during which the operating efficiency of the refrigeration cycle apparatus decreases can be shortened.

In the refrigeration cycle apparatus according to Embodiment 1, the compressor 11 is controlled such that the low pressure Ps in the refrigeration cycle circuit 10 approaches the target pressure Psm. In the operation state, the notification part 36 issues notification of an abnormality of the high pressure valve 46*a* when the value obtained by subtracting the target pressure Psm from the low pressure Ps is greater than the threshold and the compressor 11 operates at the maximum operating frequency.

When an abnormality occurs in the high pressure valve 46*a* in the operation state, and the amount of refrigerant passing through the bypass flow path 44 increases, the low pressure Ps cannot be maintained at the target pressure Psm even when the operating frequency of the compressor 11 is increased to the maximum operating frequency. Thus, with the configuration described above, an abnormality of the high pressure valve 46*a* can be detected more accurately.

The refrigeration cycle apparatus according to Embodiment 1 further includes the operation mode switching unit 37, which switches the operation mode of the refrigeration cycle apparatus. The operation mode switching unit 37 can switch the operation mode at least to an operation mode in which operation is performed in the operation state. With this configuration, even during a period in which the indoor unit 2*a* performs the heating operation, an abnormality of the low pressure valve 45*a*, the high pressure valve 46*a*, or the electronic expansion valve 21*a* can be detected.

REFERENCE SIGNS LIST

1: outdoor unit, 2*a*, 2*b*: indoor unit, 3: controller, 4: branch controller, 10: refrigeration cycle circuit, 11: compressor, 12: outdoor heat exchanger, 13: outdoor fan, 14: refrigerant flow switching device, 15: high-pressure sensor, 16: low-pressure sensor, 21*a*, 21*b*: electronic expansion valve, 22*a*, 22*b*: indoor heat exchanger, 25*a*, 25*b*: indoor fan, 31: memory unit, 32: extraction unit, 33: calculation unit, 34: comparison unit, 35: determination unit, 36: notification part, 37: operation mode switching unit, 41: first branch part, 42*a*, 42*b*: second branch part, 43: gas-liquid separator, 44: bypass flow path, 44*a*, 44*b*: branch flow path, 45*a*, 45*b*: low pressure valve, 46*a*, 46*b*: high pressure valve, TH1*a*, TH1*b*: first temperature sensor, TH2*a*, TH2*b*: second temperature sensor, TH3*a*, TH3*b*: third temperature sensor.

The invention claimed is:

1. A refrigeration cycle apparatus comprising:

a refrigeration cycle circuit including a compressor, a refrigerant flow switching device, an outdoor heat exchanger, an expansion device, and an indoor heat exchanger;

a bypass flow path connecting a first branch part provided between the outdoor heat exchanger and the expansion device in the refrigeration cycle circuit to a second branch part provided between the indoor heat exchanger and the refrigerant flow switching device in the refrigeration cycle circuit;

a first valve provided between the second branch part and the refrigerant flow switching device in the refrigeration cycle circuit;

a second valve provided at the bypass flow path;

a first temperature sensor configured to detect a temperature of an indoor space to which air passing through the indoor heat exchanger is supplied;

a second temperature sensor configured to detect a temperature of refrigerant on a liquid side of the indoor heat exchanger; and a notification part configured to perform abnormality notification, wherein the expansion device is an electronic expansion valve, the refrigeration cycle apparatus is able to operate in an operation state where the compressor operates, the indoor heat exchanger functions as an evaporator, and the first valve is open while the second valve is closed, in the operation state, the notification part issues notification of an abnormality of the electronic expansion valve or the first valve when a temperature detected by the second temperature sensor is higher than an evaporation temperature of the refrigerant in the refrigeration cycle circuit, and in the operation state, the notification part issues notification of an abnormality of the first valve when the temperature detected by the second temperature sensor is higher than a temperature detected by the first temperature sensor.

2. A refrigeration cycle apparatus comprising:

a refrigeration cycle circuit including a compressor, a refrigerant flow switching device, an outdoor heat exchanger, an expansion device, and an indoor heat exchanger;

a bypass flow path connecting a first branch part provided between the outdoor heat exchanger and the expansion device in the refrigeration cycle circuit to a second branch part provided between the indoor heat exchanger and the refrigerant flow switching device in the refrigeration cycle circuit;

a first valve provided between the second branch part and the refrigerant flow switching device in the refrigeration cycle circuit;

a second valve provided at the bypass flow path;

a first temperature sensor configured to detect a temperature of an indoor space to which air passing through the indoor heat exchanger is supplied;

a second temperature sensor configured to detect a temperature of refrigerant on a liquid side of the indoor heat exchanger; and a notification part configured to perform abnormality notification, wherein the expansion device is an electronic expansion valve, the refrigeration cycle apparatus is able to operate in an operation state where the compressor operates, the indoor heat exchanger functions as an evaporator, and the first valve is open while the second valve is closed, in the operation state, the notification part issues notification of an abnormality of the electronic expansion valve or the first valve when a temperature detected by the second temperature sensor is higher than an evaporation temperature of the refrigerant in the refrigeration cycle circuit, and in the operation state, the notification part issues notification of an abnormality of the electronic expansion valve when the temperature detected by the second temperature sensor is higher than the evaporation temperature and less than or equal to a temperature detected by the first temperature sensor.

3. A refrigeration cycle apparatus comprising:

a refrigeration cycle circuit including a compressor, a refrigerant flow switching device, an outdoor heat exchanger, an expansion device, and an indoor heat exchanger;

a bypass flow path connecting a first branch part provided between the outdoor heat exchanger and the expansion device in the refrigeration cycle circuit to a second branch part provided between the indoor heat exchanger and the refrigerant flow switching device in the refrigeration cycle circuit;

a first valve provided between the second branch part and the refrigerant flow switching device in the refrigeration cycle circuit;

a second valve provided at the bypass flow path;

a first temperature sensor configured to detect a temperature of an indoor space to which air passing through the indoor heat exchanger is supplied;

a second temperature sensor configured to detect a temperature of refrigerant on a liquid side of the indoor heat exchanger; and a notification part configured to perform abnormality notification, wherein the expansion device is an electronic expansion valve, the refrigeration cycle apparatus is able to operate in an operation state where the compressor operates, the indoor heat exchanger functions as an evaporator, and the first valve is open while the second valve is closed, in the operation state, the notification part issues notification of an abnormality of the electronic expansion valve or the first valve when a temperature detected by the second temperature sensor is higher than an evaporation temperature of the refrigerant in the refrigeration cycle circuit, and in the operation state, the notification part issues notification of an abnormality of the second valve when an amount of refrigerant passing through the compressor is greater than an amount of refrigerant passing through the expansion device.

4. A refrigeration cycle apparatus comprising:

a refrigeration cycle circuit including a compressor, a refrigerant flow switching device, an outdoor heat exchanger, an expansion device, and an indoor heat exchanger;

a bypass flow path connecting a first branch part provided between the outdoor heat exchanger and the expansion device in the refrigeration cycle circuit to a second branch part provided between the indoor heat exchanger and the refrigerant flow switching device in the refrigeration cycle circuit;

a first valve provided between the second branch part and the refrigerant flow switching device in the refrigeration cycle circuit;

a second valve provided at the bypass flow path;

a first temperature sensor configured to detect a temperature of an indoor space to which air passing through the indoor heat exchanger is supplied;

a second temperature sensor configured to detect a temperature of refrigerant on a liquid side of the indoor heat exchanger; and a notification part configured to perform abnormality notification, wherein the expansion device is an electronic expansion valve, the refrigeration cycle apparatus is able to operate in an operation state where the compressor operates, the indoor heat exchanger functions as an evaporator, and the first valve is open while the second valve is closed, in the operation state, the notification part issues notification of an abnormality of the electronic expansion valve or the first valve when a temperature detected by the second temperature sensor is higher than an evaporation temperature of the refrigerant in the refrigeration cycle circuit, the compressor is controlled such that a low pressure in the refrigeration cycle circuit approaches a target pressure, and in the operation state, the notification part issues notification of an abnormality of the second valve when a value obtained by subtracting the target pressure from the low pressure is greater than a threshold.

5. A refrigeration cycle apparatus comprising:

a refrigeration cycle circuit including a compressor, a refrigerant flow switching device, an outdoor heat exchanger, an expansion device, and an indoor heat exchanger;

a bypass flow path connecting a first branch part provided between the outdoor heat exchanger and the expansion device in the refrigeration cycle circuit to a second branch part provided between the indoor heat exchanger and the refrigerant flow switching device in the refrigeration cycle circuit;

a first valve provided between the second branch part and the refrigerant flow switching device in the refrigeration cycle circuit;

a second valve provided at the bypass flow path;

a first temperature sensor configured to detect a temperature of an indoor space to which air passing through the indoor heat exchanger is supplied;

a second temperature sensor configured to detect a temperature of refrigerant on a liquid side of the indoor heat exchanger; and a notification part configured to perform abnormality notification, wherein the expansion device is an electronic expansion valve, the refrigeration cycle apparatus is able to operate in an operation state where the compressor operates, the indoor heat exchanger functions as an evaporator, and the first valve is open while the second valve is closed, in the operation state, the notification part issues notification of an abnormality of the electronic expansion valve or the first valve when a temperature detected by the second temperature sensor is higher than an evaporation temperature of the refrigerant in the refrigeration cycle circuit, the compressor is controlled such that a low pressure in the refrigeration cycle circuit approaches a target pressure, and in the operation state, the notification part issues notification of an abnormality of the second valve when a value obtained by subtracting the target pressure from the low pressure is greater than a threshold and the compressor operates at a maximum operating frequency.

6. The refrigeration cycle apparatus of claim 1, further comprising: an operation mode switching unit configured to switch an operation mode, wherein the operation mode switching unit is able to perform switching at least to an operation mode in which operation is performed in the operation state.

* * * * *